US005539424A

United States Patent [19]

Hattori et al.

[11] Patent Number: 5,539,424

[45] Date of Patent: Jul. 23, 1996

[54] THIN-FILM ELECTROLUMINESCENCE DISPLAY DEVICE

[75] Inventors: Yutaka Hattori, Okazaki; Atsushi Mizutani, Aichi-gun; Nobuei Ito, Chiryu; Tadashi Hattori, Okazaki, all of Japan

[73] Assignees: Nippondenso Co., Ltd., Kariya; Research Development Corporation of Japan, Tokyo, both of Japan

[21] Appl. No.: 197,492

[22] Filed: Feb. 16, 1994

Related U.S. Application Data

[63] Continuation of Ser. No. 979,315, Nov. 20, 1992, abandoned.

[30] Foreign Application Priority Data

Nov. 22, 1991 [JP] Japan ..... 3-334180

[51] Int. Cl.[6] ..... G09G 3/30

[52] U.S. Cl. ..... 345/76; 345/45; 313/509

[58] Field of Search ..... 313/110, 112, 313/117, 498, 506, 507, 509; 345/45, 32, 76

[56] References Cited

U.S. PATENT DOCUMENTS

| | | | |
|---|---|---|---|
| 1,772,917 | 8/1930 | Sifferman . | |
| 2,685,365 | 8/1954 | Sieven . | |
| 2,790,608 | 4/1957 | Sieven . | |
| 2,872,124 | 2/1959 | Sieven . | |
| 3,038,677 | 6/1962 | Schermerhorn . | |
| 3,297,265 | 1/1967 | Turro . | |
| 3,834,636 | 9/1974 | Linick . | |
| 3,837,595 | 9/1974 | Boone . | |
| 3,848,822 | 11/1974 | Boone . | |
| 4,103,838 | 8/1978 | Young . | |
| 4,354,643 | 10/1982 | Kenner . | |
| 4,396,864 | 8/1983 | Suntola et al. . | |
| 4,713,493 | 12/1987 | Ovshinsky . | |
| 4,830,301 | 6/1989 | Miller . | |
| 4,954,747 | 9/1990 | Tuenge et al. . | |
| 4,963,788 | 10/1990 | King et al. | 313/512 |
| 5,055,739 | 10/1991 | Thioulouse . | |
| 5,066,551 | 11/1991 | Kojima . | |
| 5,142,192 | 8/1992 | Takahashi et al. . | |

FOREIGN PATENT DOCUMENTS 1-315987 12/1989 Japan .

OTHER PUBLICATIONS

Richard T. Tuenge, "Bright Red EL Using a Thin-Film Filter", SID 91 Digest, May 6, 1991, pp. 279–281.

*Primary Examiner*—Ulysses Weldon
*Assistant Examiner*—Matthew Luu
*Attorney, Agent, or Firm*—Cushman, Darby & Cushman

[57] ABSTRACT

A thin-film EL display device of red luminescent color having high luminous intensity and high reliability is disclosed. The thin-film EL display device has a first transparent electrode, a first transparent insulating layer, a light-emitting layer of zinc sulfide (ZnS) with the addition of manganese (Mn), a red-light transmitting filter of amorphous silicon (a-Si), a second transparent insulating layer, and a second transparent electrode (second electrode), which are successively deposited one on top of another on a glass substrate. The EL display device produces red light from orange light emission from the light-emitting layer. High temperature resistance of the filter permits the insertion of the filter to a desired position during the fabrication process for the thin-film EL display device. Furthermore, since the filter characteristics of the thin-film EL display do not suffer degradation by the heat generated during the light emitting operation thereof, there is no concern for luminescent color deterioration with time.

2 Claims, 6 Drawing Sheets

THIN-FILM ELECTROLUMINESCENCE DISPLAY DEVICE

This application is a continuation of our application Ser. No. 07/979,315 the content of which is incorporated herewith by reference now abandoned.

BACKGROUND OF THE INVENTION

1. Field of the Invention

The present invention relates to a thin-film electroluminescence (EL) display device used, for example, as an area light source for back lighting an instrument or the like.

2. Description of Related Art

Thin-film EL display devices, utilizing the emission of light by phosphorescent substances under the influence of an applied electric field, have been attracting attention as components for forming self luminous flat panel displays.

FIG. 1 is a schematic diagram showing a typical cross sectional structure of a thin-film EL display device 10 of prior art.

The thin-film EL display device 10 comprises a first electrode 2 of an optically transparent ITO (indium tin oxide) film, a first insulating layer 3 made of tantalum pentoxide ($Ta_2O_5$) or the like, a light-emitting layer 4, a second insulating layer 5, and a second electrode 6 of an ITO film, which are successively deposited one on top of another on an insulating glass substrate 1.

The ITO film, a transparent conductive film made of indium oxide ($In_2O_3$) doped with tin (Sn), has been widely used for a transparent electrode because of its low resistivity.

The light-emitting layer 4 is made, for example, of zinc sulfide as the base material, with additions of manganese (Mn) or terbium trifluoride ($TbF_3$) as the luminescence center. The luminescent color of the thin-film EL display device is determined by the kind of additive in the zinc sulfide, the luminescence being orange colored when manganese (Mn) is added as the luminescent center, and green colored when terbium trifluoride ($TbF_3$) is added, for example.

In the thin-film EL display device 10 of the above structure, zinc sulfide with the addition of samarium trifluoride ($SmF_3$), for example, has been considered for the material for forming a light-emitting layer 4 that exhibits red color luminescence.

However, the thin-film EL display device 10 using the light-emitting layer 4 formed from this material can only provide a luminous intensity as low as 1000 cd/cm$^2$ at the maximum (when driven at 5 Khz) and has poor color purity since its emission spectrum contains components having wavelengths shorter than that of red light, and therefore, at the current level of development, it is not suitable for use in an EL panel or other display devices.

To overcome this problem, there has recently been proposed a method in which, in order to produce red colored light, a filter that cuts off the wavelengths of light shorter than 570 nm is used with a thin-film EL display device comprising a ZnS/Mn light-emitting layer that emits orange light. It is claimed that since the luminous intensity of the original orange light is high, this thin-film EL display device can produce red light of sufficient luminance even when passed through a filter.

However, since the filter is formed by a printing process using a paint containing a pigment and binder, its heat resisting temperature is as low as about 200° C. It is therefore not possible to insert the filter during the thin-film EL display device fabrication process in which various layers are deposited on a glass substrate by vapor deposition, sputtering, etc. while the glass substrate is being heated. This leaves no other choice but to form the filter after formation of the various layers of the thin-film EL display device, which limits the selection of the position into which the filter can be inserted. There is also the problem that the paint characteristics suffer degradation by the heat generated during the light emitting operation of the thin-film EL display device, which not only causes the luminescent color to change with time but eventually leads to the deterioration of the device characteristics.

Furthermore, when depositing an insulating film of tantalum pentoxide ($Ta_2O_5$) on the light-emitting layer made of zinc sulfide (ZnS) as the matrix, the surface of the zinc sulfide is oxidized by an oxygen plasma, resulting in the formation of a zinc sulfate ($ZnSO_4$) layer. The formation of the zinc sulfate ($ZnSO_4$) layer is dependent on such factors as the oxygen concentration, substrate temperature, and deposition time during the deposition of the insulating layer of tantalum pentoxide ($Ta_2O_5$). Since zinc sulfate ($ZnSO_4$) is extremely soluble in water, the problem is that the adhesion between the light-emitting layer and the insulating layer is impaired during a subsequent process such as a rinsing or cleaning process, giving a rise to the possibility of separation between these two layers.

Another problem with the prior art is that because of variations in the thickness of the zinc sulfate ($ZnSO_4$) layer, etc., the light emitting characteristics and reliability of the thin film EL display device are extremely unstable.

SUMMARY OF THE INVENTION

In view of the above enumerated problems with the prior art, it is an object of the present invention to provide a thin-film EL display device of red luminescent color having high luminous intensity and high reliability.

The thin-film EL display device of the present invention, which overcomes the above enumerated problems, comprises a first electrode, a first insulating layer, a light-emitting layer, a second insulating layer, a second-emitting layer, a second insulating layer, and a second electrode, which are successively formed on an insulating substrate, the layers lying in the path of light emission being made of transparent materials, the thin-film EL display device being characterized by the inclusion of a filter made of silicon or a silicon alloy, the filter being placed in the path of light emission from the light-emitting layer.

Preferably, the filter disposed in the path of light emission from the light emitting layer, is made of amorphous silicon or a silicon alloy.

The thus structured thin-film EL display device is adapted to produce red light from the orange light emitted from the light-emitting layer, for example, made of zinc sulfide/manganese (ZnS/Mn).

High temperature resistance of the filter permits the insertion of the filter into desired position during the fabrication process for the thin-film EL display device. Furthermore, since the filter characteristics of the thin-film EL display do not suffer degradation by the heat during the light emitting operation thereof, there is no concern of the luminescent color deteriorating with time. Thus according to the thin-film EL display device of the invention, the light emitting characteristics are stabilized, and reliability is enhanced.

Furthermore, in a thin-film EL display device in which the filter is formed between the light-emitting layer and the first or second insulating layer, the light-emitting layer is not in contact with the first or second insulating layer. This prevents the light emitting layer made of zinc sulfide (ZnS) as the matrix material from being exposed to an oxygen plasma.

As a result, there is no possibility that a zinc sulfate ($ZnSO_4$) layer having extremely high water solubility will be formed on the surface of the light emitting layer. This greatly improves the adhesion between the light-emitting layer and the first or second insulating layer with the filter interposed between them, thus stabilizing the light emitting characteristics and improving the reliability of the thin-film EL display device of the invention.

DESCRIPTION OF THE PREFERRED EMBODIMENTS

The preferred embodiments of the present invention are now described with reference to the accompanying drawings.

Figure 2:
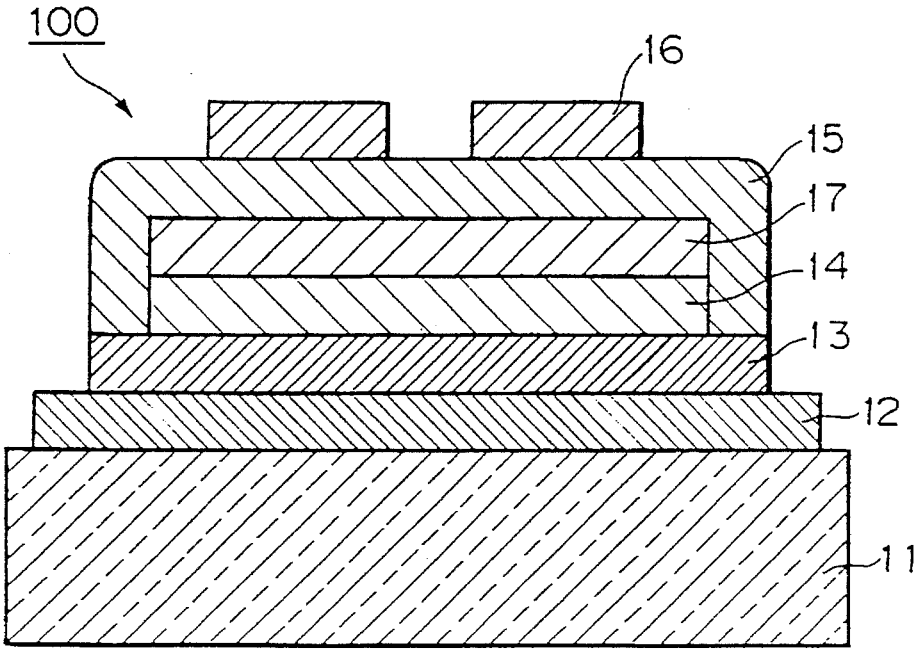
FIG. 2 is a schematic vertical cross sectional view of a thin-film EL display device according to one embodiment of the present invention.

FIG. 2 is a schematic diagram showing a vertical cross sectional view of a thin-film EL display device 100 according to one embodiment of the invention.

The thin-film EL display device 100 comprises various thin films successively formed one on top of another on a glass insulating substrate 11, as described below.

On the glass substrate 11, there is deposited a first transparent electrode (first electrode) 12 of optically transparent zinc oxide (ZnO), on top of which are formed a first insulating layer 13 of optically transparent tantalum pentoxide ($Ta_2O_5$), a light-emitting layer 14 of zinc sulfide (ZnS) with the addition of manganese (Mn), a red-light transmitting filter 17 of amorphous silicon (a-Si), a second insulating layer 15 of optically transparent tantalum pent oxide ($Ta_2O_5$), and a second transparent electrode (second electrode) 16 of optically transparent zinc oxide (ZnO).

A fabrication process sequence for the thin film EL display device 100 of the above structure is described below.

First, the first transparent electrode 12 was deposited on the glass substrate 11. To prepare the material to be evaporated, zinc oxide (ZnO) powder was mixed with gallium oxide ($Ga_2O_3$) and the mixture was molded into pellets. As the film deposition equipment, ion plating equipment was used.

More specifically, the ion plating equipment was evacuated to $5\times10^{-3}$ Pa, with the glass substrate 11 held at a temperature of 150° C. Then, argon (Ar) gas was introduced to partially backfill the equipment to $6.5\times10^{-1}$ Pa, and the beam power and high frequency power were adjusted so that the rate of deposition was maintained within the range of 0.1 to 0.3 nm/sec.

Next, the first insulating layer 13 of tantalum pentoxide ($Ta_2O_5$) was deposited on top of the first transparent electrode 12 by sputtering.

More specifically, sputtering equipment was maintained at 1.0 Pa, with the glass substrate 11 held at a temperature of 200° C., and a mixture of argon (Ar) and oxygen ($O_2$) gases was introduced into the equipment (at the rate of 200 cm $^3$/min). Sputtering was conducted in the thus regulated equipment, with the radio frequency power maintained at 1 kW for the deposition rate of 0.2 nm/sec.

The zinc sulfide/manganese (ZnS/Mn) light-emitting layer 14, the zinc sulfide (ZnS) being the matrix material and the manganese (Mn) added as the luminescence center, was formed by vapor deposition on the first insulating layer 13.

More specifically, electron beam deposition was conducted with the glass substrate 11 held at 120° C., the sputtering equipment maintained at $5\times10^{-4}$ Pa or lower, and the rate of deposition adjusted to 0.1 to 0.3 nm/sec.

Next, the red-light transmitting filter 17 of amorphous silicon (a-Si), in accordance with the present invention, was formed on top of the light-emitting layer 14.

More specifically, with the glass substrate 11 held at a temperature of 200° C., silane gas ($SiH_4$) diluted to 10% with hydrogen ($H_2$) was introduced in the amount of 100 sccm into radio-frequency plasma CVD equipment, and the rate of evacuation was so adjusted as to maintain the internal pressure of the equipment at 1.0 Pa. Deposition was conducted in the thus regulated equipment, with the radio-frequency power maintained at 50 W for the deposition rate of 1.5 nm/sec.

The optical gap (optical energy band gap) Eg of the resulting red-light transmitting filter 17 was about 1.81 eV. When the light transmission characteristics for the wavelength range of 500 to 750 nm were measured with a spectrophotometer, the transmittance was the greatest (55%) at 600 nm in that wavelength range, and the transmittance for the wavelengths shorter than the cut-off wavelength of 570 nm was 5% or less.

Since the transmittance fluctuates in a waving manner because of the interference with the underlying material, the transmittance can be made the greatest for any desired wavelength range just by adjusting the thickness of the red-light transmitting filter 17. Also, the optical gap of the amorphous silicon (a-Si) film can be varied between 1.70 eV and 2.10 eV by appropriately selecting the deposition conditions such as the temperature of the glass substrate 11 and the radio frequency power to be applied; this optical gap essentially determines the wavelength at which the transmittance decreases to zero.

Next, the second insulating layer 15 of tantalum pentoxide ($Ta_2O_5$) was deposited over the red-light transmitting filter 17 by the same process as for the first insulating layer 13.

After the above layers were formed on the glass substrate 11, the glass substrate 11 was heat-treated at temperatures of 400°–600° C. for two hours in a vacuum of $5\times10^{-4}$ Pa. As a result of the heat treatment, the crystallinity of the light-emitting layer 14 was improved, achieving an enhanced luminous intensity.

After the heat treatment, the second transparent electrode 16 of a zinc oxide (ZnO) film was deposited on top of the second insulating layer 15 by the same process as for the first transparent electrode 12.

The thicknesses of the thus deposited layers were 300 nm for the first and second transparent electrodes 12 and 16, 400 nm for the first and second insulating layers 13 and 15, 600 nm for the light-emitting layer 14, and 300 nm for the red-light transmitting filter 17.

When the emission spectrum of the thus fabricated thin-film EL display device was measured, it was found that the peak of the spectrum was shifted toward a longer wavelength side to 610 nm, so that red-colored luminescence of good color purity was obtained.

Figure 3:
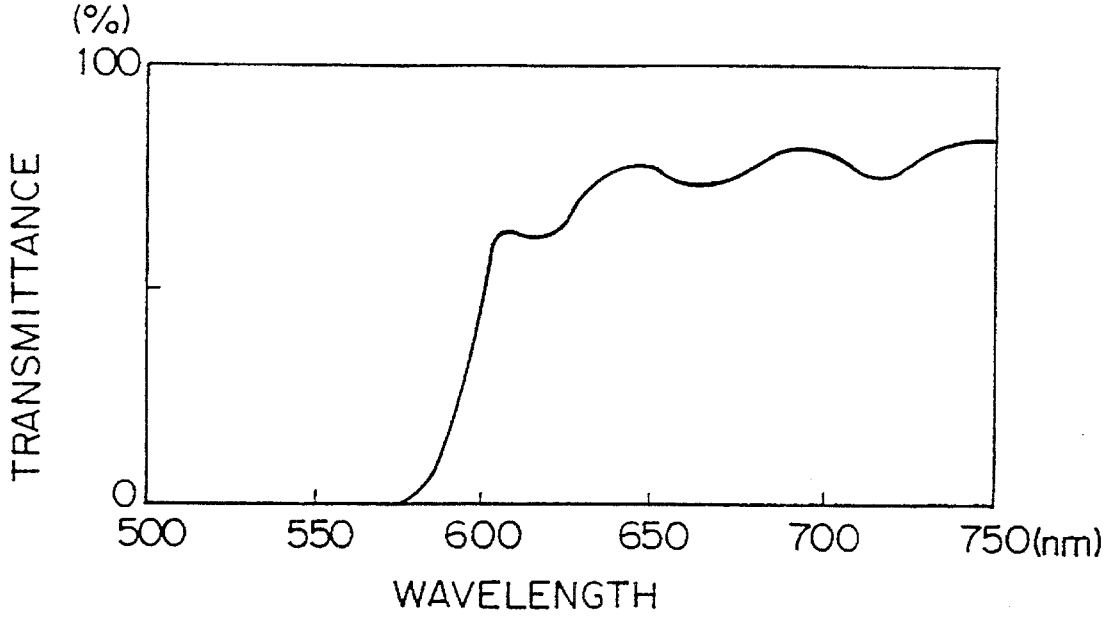
FIG. 3 is a characteristic diagram showing the visible light transmission curve, measured on a spectrophotometer, of a red-light transmitting filter used in the thin-film EL display device of FIG. 2.

FIG. 3 is a characteristic diagram showing the visible light transmission curve, measured on a spectrophotometer, of the red-light transmitting filter 17 used in the thin-film EL display device 100.

When the red-light transmitting filter 17 was not used, the thin-film EL display device having the zinc sulfide/manganese (ZnS/Mn) light-emitting layer 14 exhibited orange colored luminescence whose luminance measured about 2800 cd/m$^2$ (when driven at 1 kHz); the transmittance of the red-light transmitting filter 17 was about 21%.

Maxima and minima appear on the illustrated transmission curve because of the interference of light, the shape of the transmission curve being determined by the indices of refraction and the thicknesses of the glass substrate and the layers deposited thereon.

The thickness of the red-light transmitting filter 17 whose transmission characteristic is represented by the illustrated curve is about 300 nm, and the optical gap obtained from the absorption end where the transmittance decreases to zero is 1.72 eV. The wavelength at which the transmittance decreases to zero is determined by the optical gap of the red-light transmitting filter 17; with a wider optical gap, this wavelength shifts toward a shorter wavelength side.

Figure 4:
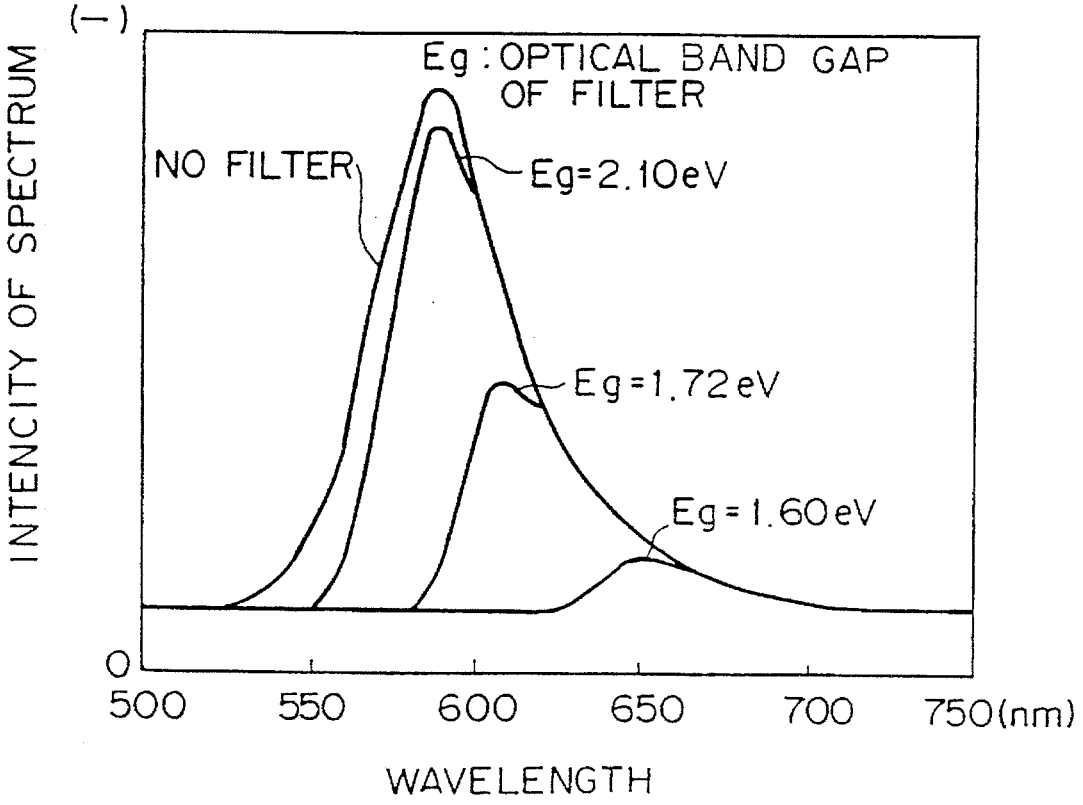
FIG. 4 is a characteristic diagram showing the emission spectra of thin-film EL display devices each using an amorphous silicon (a-Si) filter with a different optical gap Eg.

FIG. 4 is a characteristic diagram showing the emission spectra of thin-film EL display devices each using an amorphous silicon (a-Si) filter with a different optical gap Eg.

It can be seen from the diagram that the peak of the spectrum shifts toward a longer wavelength side, i.e. toward that of red light, by reducing the optical gap of the filter used in the thin-film EL display device having the zinc sulfide/manganese (ZnS/Mn) light-emitting layer.

As can be seen, at 2.10 eV, the filter effect for red coloration is nearly zero since the optical gap is too wide. Conversely, when the optical gap is as narrow as 1.60 eV, the peak substantially shifts toward the red light side, but the transmittance drops below 10%, so that the luminance of red color components is not sufficient unless the luminance of the zinc sulfide/manganese (ZnS/Mn) light-emitting layer is increased.

Figure 5:
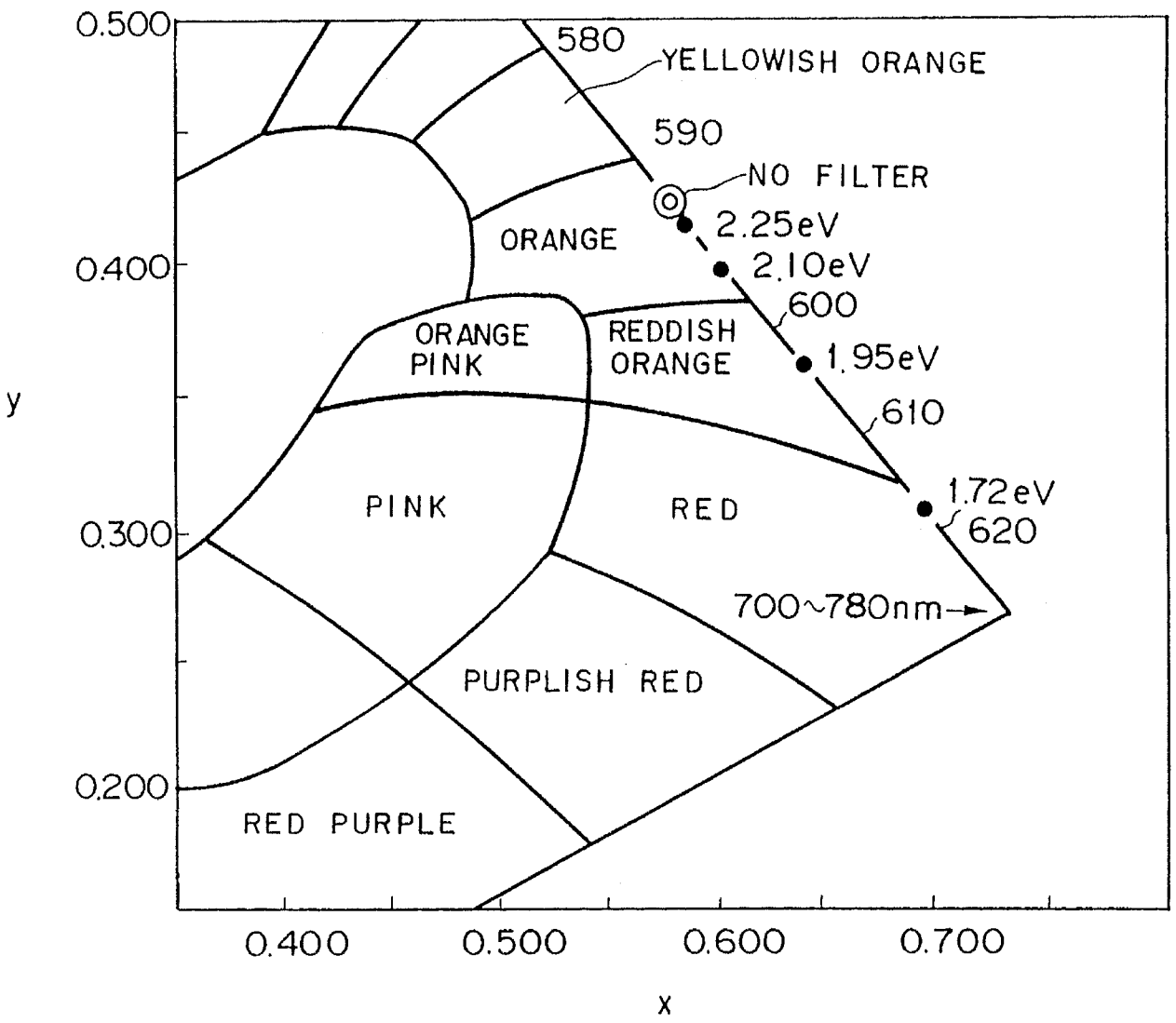
FIG. 5 is a CIE chromaticity diagram on which the emission spectra shown in FIG. 4 are plotted against x, y coordinates.

FIG. 5 is a chromaticity diagram, as specified by CIE (International Committee on Illumination), on which the emission spectra of FIG. 4 are plotted against x, y coordinates. Each optical gap value Eg teV) is plotted as a black dot whose position is represented by a set of CIE coordinates. The position indicated by a double circle with the designation of "No filter" shows the orange light emission spectrum of a thin-film EL display device having a ZnS/Mn light-emitting layer of prior art.

As can be seen from the diagram, the chromaticity shifts from orange toward red as the optical gap is made narrower.

As compared with a thin-film EL display device having a zinc sulfide/samarium (ZnS/Sm) light-emitting layer, the chromaticity at the optical gap 1.72 eV is further shifted toward the red color side, which is comparable to that of a thin-film EL display device having a calcium sulfide/europium (CaS/Eu) light-emitting layer which is currently considered to have the best color purity.

Figure 6:
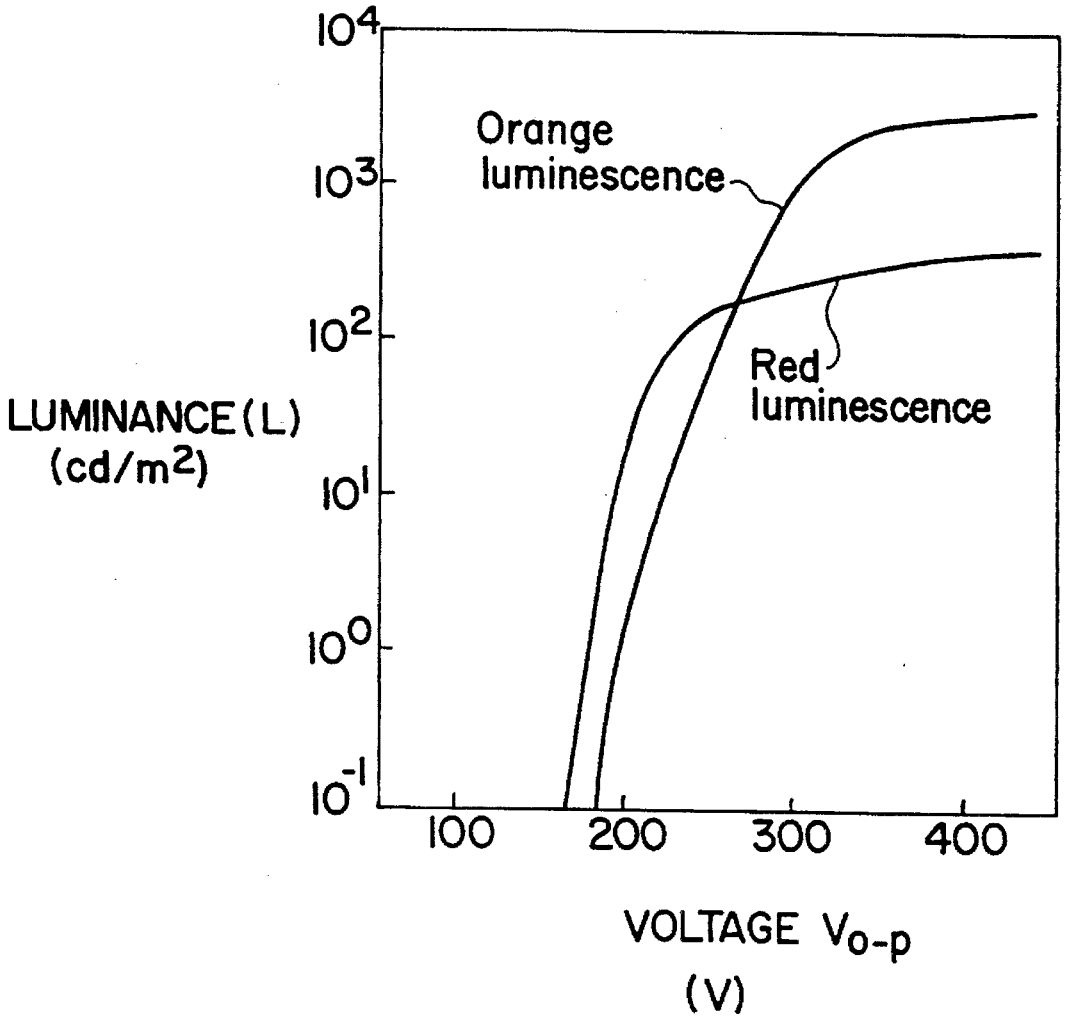
FIG. 6 is a characteristic diagram showing the luminance as a function of the applied voltage for the thin-film EL display device of the invention (red luminescence) by comparison with a thin-film EL display device with no filter.

FIG. 6 is a characteristic diagram showing the luminance as a function of the applied voltage for the thin-film EL display device of the invention (red luminescence) by comparison with the thin-film EL display device with no filter.

As compared with the orange light emission obtained from the prior art thin-film EL display device having a zinc sulfide/manganese (ZnS/Mn) light-emitting layer with no filter, the thin-film EL display device having the zinc sulfide/manganese (ZnS/Mn) light-emitting layer with the filter of the present invention provides a lower transmittance which measures about 20%. Accordingly, the red color luminance of the thin-film EL display device of the invention is 450 cd/cm$^2$ (when driven at 1 kHz), but the emission starting voltage is reduced from 192 V by more than 10% to 171 V, and the luminance curve rises steeply.

This is presumably because the amount of the charge injected into the light-emitting layer increases upon the initiation of light emission since the amorphous silicon (a-Si) layer forming the red-light transmitting filter 17 has a photo electromotive force.

The orange light luminance of the thin-film EL display device of this embodiment is about 2200 cd/cm$^2$ (when driven at 1 kHz), but if the luminance can be increased by improving the film material, etc., the luminance of the red light emission can also be increased accordingly.

Figure 1:
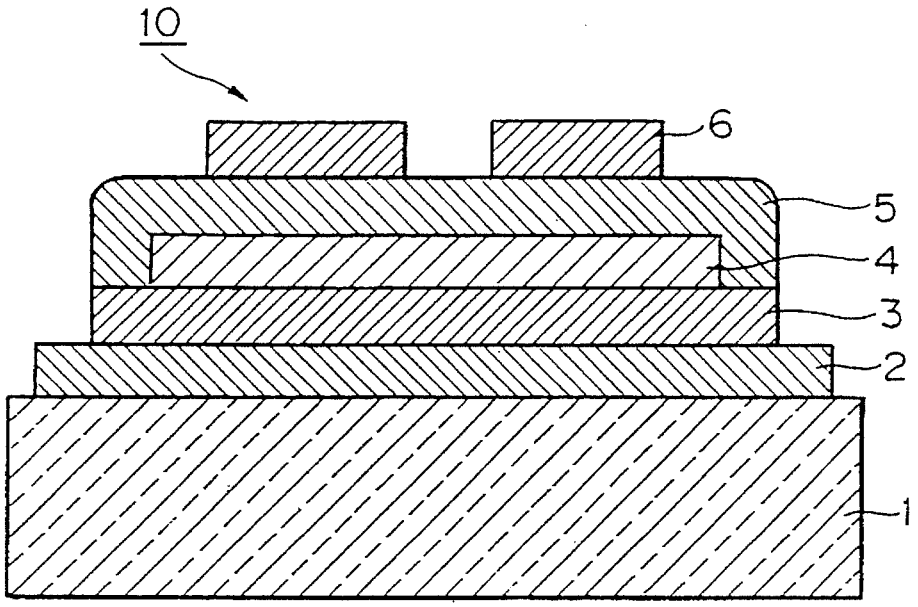
Fig. 1 PRIOR ART
FIG. 1 is a schematic diagram showing a vertical cross sectional view of a thin-film EL display device of prior the art.

Next, a thin-film EL display device of the prior art structure with no filter, as shown in FIG. 1, was fabricated for comparison purposes.

The structure and the fabrication process are the same as those for the thin-film EL display device 100 of the present invention, except that the red-light transmitting filter 17 is omitted and that the light emitting layer 14 is replaced by a red light emitting layer 33 formed by sputtering using the target made from zinc sulfide (ZnS) with the addition of one weight percent samarium trifluoride ($SmF_3$) as the luminescence center.

A light emitting test similar to that described previously was conducted on the thin-film EL display device of the prior art structure with no filter, as a result of which it was found that the luminance was as low as about 200 cd/m$^2$ and that the color purity was approximately at the same level as that of the thin film EL display device with a red-light transmitting filter having an optical gap Eg=1.95 eV, shown in FIG. 5.

Figure 7:
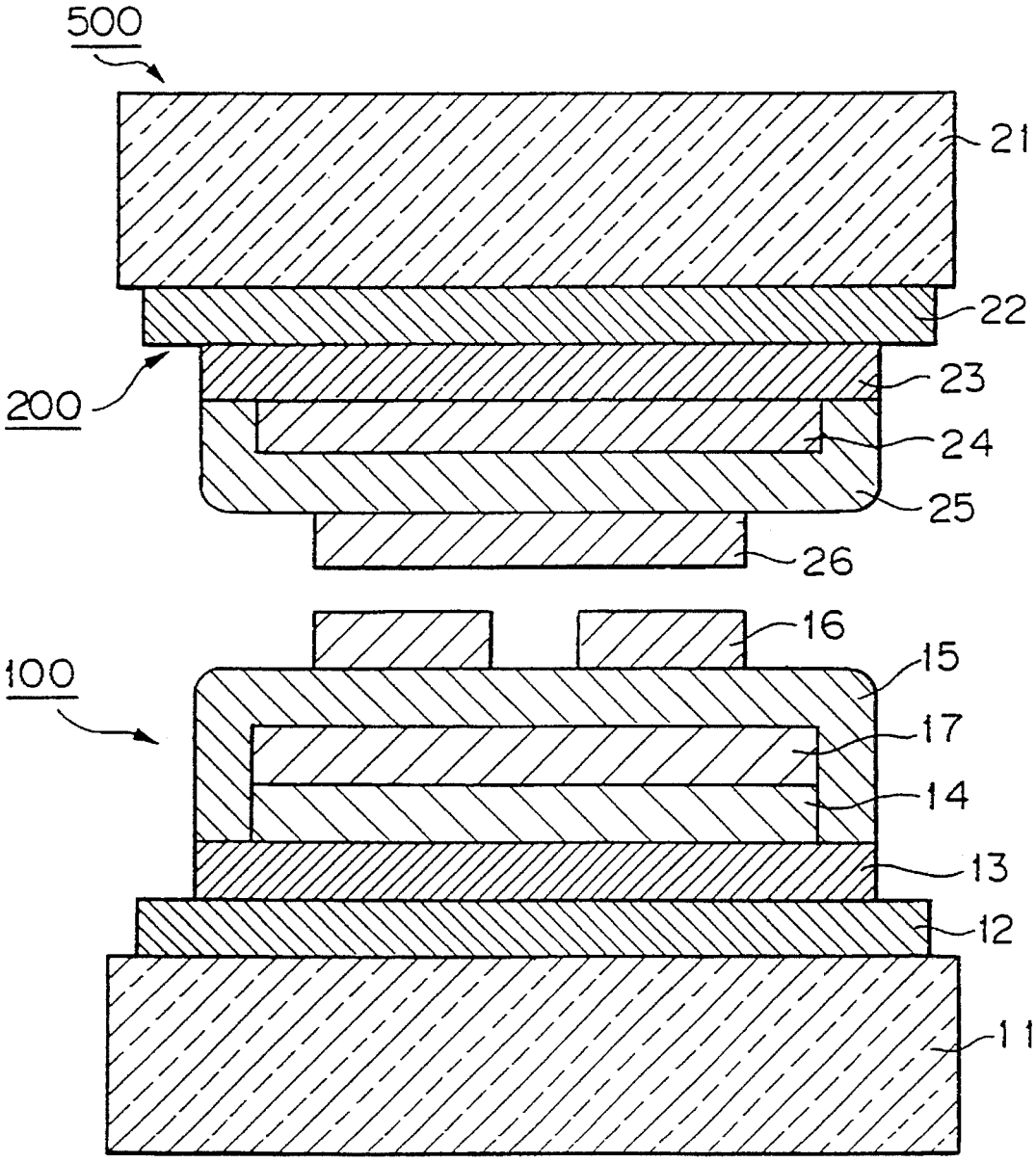
FIG. 7 is a schematic vertical cross sectional view of a thin-film EL display device according to another embodiment of the present invention.

FIG. 7 is a schematic diagram showing a vertical cross sectional view of a thin-film EL display device according to a second embodiment of the present invention.

The thin-film EL display device 500 of this embodiment has a layered device structure in which a second thin-film EL display device 200 having a second light-emitting layer 24 is formed on top of the structure of the red-light emitting thin-film EL display device 100 of the foregoing first embodiment. In FIG. 2, the reference numerals designating the layers forming the thin-film EL display device 100 of the first embodiment are the same as those in FIG. 2, and their explanatory descriptions are omitted herein.

In the fabrication of the second thin film EL display device 200, a third transparent electrode 22 of zinc oxide (ZnO) and a third insulating layer 23 of tantalum pentoxide ($Ta_2O_5$) were deposited on a glass substrate 21 (on the underside thereof in the diagram) by the same process as that for the foregoing embodiment. Next, on top of that, the second light emitting layer 24 was deposited by sputtering. The second light-emitting layer 24 was made of zinc sulfide (ZnS) as the matrix material, with the addition of terbium/oxygen/fluorine (TbOF) as the luminescence center to give green light.

On the second light-emitting layer 24, a fourth insulating layer 25 of tantalum pentoxide ($Ta_2O_5$) and a fourth transparent electrode 26 were deposited by the same process as that for the foregoing embodiment. The thicknesses of the layers were 450 nm for the third and fourth insulating layers 23 and 24, 800 nm for the second light-emitting layer 24, and 300 nm for the third and fourth transparent electrodes 22 and 26.

In the thin-film EL display device 500 of the above structure, a voltage is applied across the first light emitting layer 14 or the second light-emitting layer 24 to obtain red or green luminescent color, respectively. Furthermore, when the first and second light-emitting layers 14 and 24 are simultaneously excited to emit light, their luminescent colors are mixed thereby realizing a light-emitting layer of amber; therefore, multicolor capability can be provided by combining these colors.

The glass substrates 11 and 21 are mounted with vacuum injection of silicone oil to prevent absorption of moisture. The red and green colored lights and the intermediate colored light between them are emitted through the glass substrate 21. In the above structure, the second transparent electrode 16 and the fourth transparent electrode 26 may be formed in common. That is, after forming the second transparent electrode 16, the fourth insulating layer 25, the second light-emitting layer 24, the third insulating layer 23, and the third transparent electrode 22 may be formed successively in this order directly on top of the second transparent electrode 16. It is also possible to use the glass substrate 21 as a dummy (sacrificing), glass plate for mounting thereof with vacuum injection of silicone oil.

In either of the first and second embodiments, separation between films during a process such as a rinsing process (water cleaning), which was observed in the case of the prior art thin-film EL display device, did not occur at all. That is, the formation of a zinc sulfate ($SnSO_4$) layer having extremely high water solubility was successfully prevented. Furthermore, the luminance of the red light emission passed through the red-light transmitting filter 17 measured about 600 cm/m$^2$ (when driven at 1 kHz), enough to serve the purpose for practical use. Moreover, the filter characteristics did not suffer degradation during the high temperature process, nor with time.

The invention is not limited to the foregoing embodiments, but it will be recognized that various modifications such as described below may be made in the invention.

(1) Instead of amorphous silicon (a-Si), the red light transmitting filter 17 may be made of a material selected from the group consisting of microcrystalline silicon, polycrystalline silicon, silicon alloys such as SiC, SiSn, and SiGe generally represented as $Si_aX_b$ (X is selected from the group consisting of carbon (C), tin (Sn), and germanium (Ge); a is 0 to 1, b is (l-a)), and micro crystals and polycrystals thereof.

(2) The first, second, third, and fourth insulating layers 13, 15, 23, and 25 were made of tantalum pentoxide ($Ta_2O_5$), but these layers may be made of $Al_2O_3$, $Si_3N_4$, $PbTiO_3$, or $Y_2O_3$.

(3) Full-color capability can be provided to the thin-film EL display device if the display device is provided with three or more light-emitting layers, for example, by stacking three light-emitting layers that emit R, G, and B lights, respectively.

(4) The red-light transmitting filter may be formed from a plurality of layers. For example, a layer having the largest optical gap may be formed on the transparent electrode side, followed by successive layers with gradually decreasing optical gaps toward the light-emitting layer side. When employed in the thin-film EL display device, this structure serves to further improve the efficiency of injection of charges into the light emitting layer.

Figure 8:
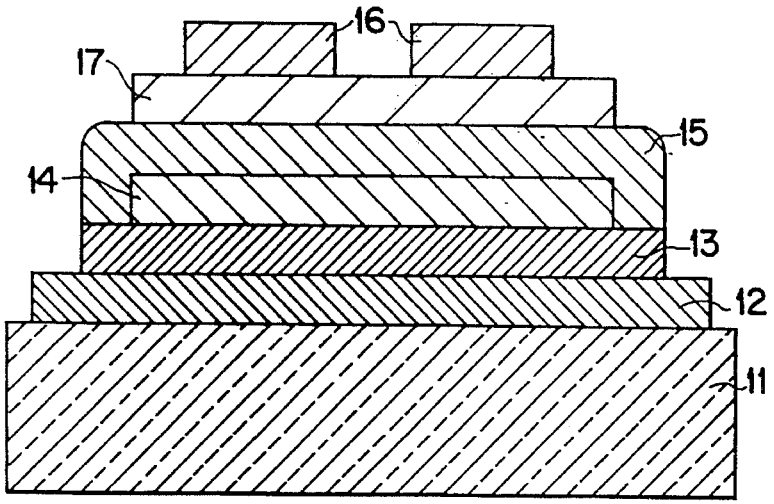
FIGS. 8, 9 and 10 are schematic vertical cross sectional views of thin-film EL display devices according to other embodiments of the present invention.

(5) The red-light transmitting filter 17 does not necessarily have to be inserted between the light emitting layer and the second insulating layer, but may be placed anywhere as long as it is positioned in the path of light emission from the light-emitting layer. For example, it may be placed between the second insulating layer and the second transparent electrode, or as shown in FIG. 8 filter 17 may be formed on the second transparent electrode 15 if an improvement in the charge injection efficiency is not sought.

Figure 9:
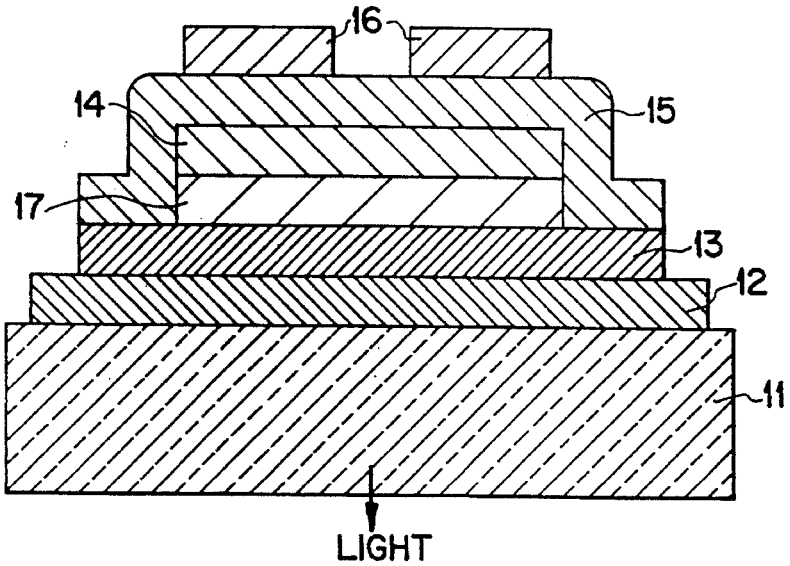

(6) When the light is emitted through the glass substrate, the filter effect can be obtained if the red light transmitting filter 17 is formed as shown in FIG. 9 between the first insulating layer 13 and the light-emitting layer 14, or even if it is formed on the side of the glass substrate opposite to the side thereof on which the first transparent electrode is formed.

Figure 10:
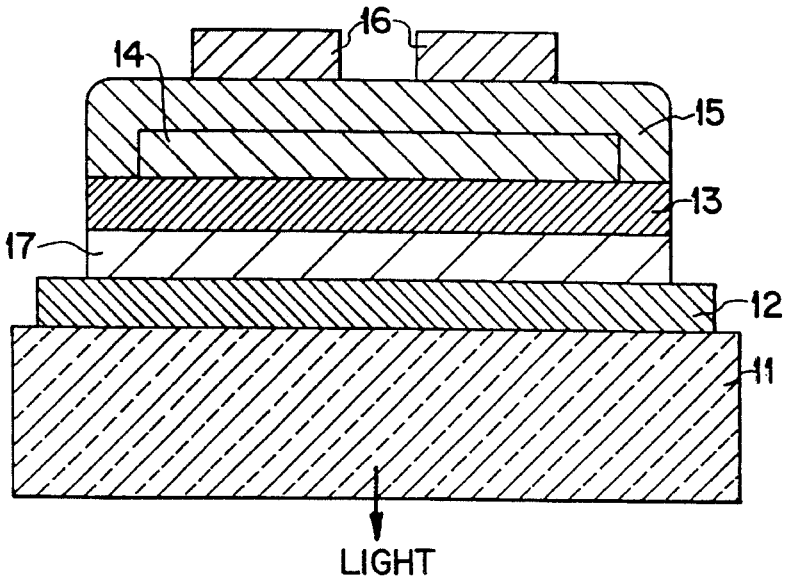

In FIG. 10, filter 17 is interposed between the first electrode 12 and the first insulating layer 13.

What is claimed is:

1. A thin-film electroluminescence (EL) display device comprising:

an insulating substrate;

a first electrode;

a first insulating layer;

a light-emitting layer for developing a path of light emission;

a second insulating layer;

a second electrode, said first electrode, said first insulating layer, said light-emitting layer, said second insulating layer and said second electrode being successively formed on said insulating substrate;

at least each of said layers lying in said path of light emission being made of a transparent material;

a filter layer made of amorphous silicon and being interposed between said light-emitting layer and said second insulating layer for increasing the number of electric charges injected into said light-emitting layer to lower an emission starting voltage.

2. A thin-film EL display device according to claim 1, wherein said filter layer has optical gap of around 1.72 eV.

* * * * *